US008698050B2

(12) United States Patent
Leonard et al.

(10) Patent No.: US 8,698,050 B2
(45) Date of Patent: Apr. 15, 2014

(54) DISPENSING DEVICE FOR HEATED FLOWABLE PRODUCT

(75) Inventors: Stephen B. Leonard, Franksville, WI (US); Thomas P. Gasper, Germantown, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1518 days.

(21) Appl. No.: 11/962,155

(22) Filed: Dec. 21, 2007

(65) Prior Publication Data

US 2009/0159586 A1 Jun. 25, 2009

(51) Int. Cl.
*H05B 1/00* (2006.01)

(52) U.S. Cl.
USPC ..... 219/433; 219/432; 219/438; 219/535

(58) Field of Classification Search
USPC ..... 219/385, 417, 428, 429, 432–436, 441, 219/521; 392/444; 222/146.5
See application file for complete search history.

(56) References Cited

U.S. PATENT DOCUMENTS

| | | | | |
|---|---|---|---|---|
| 3,843,022 | A | 10/1974 | Radcliffe et al. | |
| 4,731,522 | A * | 3/1988 | Manchester | 392/390 |
| 5,786,573 | A * | 7/1998 | Fabrikant et al. | 219/535 |
| 6,216,360 | B1 * | 4/2001 | Wertheim | 34/266 |
| 6,444,956 | B1 | 9/2002 | Witcher et al. | |
| 6,454,127 | B1 | 9/2002 | Suomela et al. | |
| 6,935,535 | B2 * | 8/2005 | Pandolfi et al. | 222/146.5 |
| 7,158,717 | B2 | 1/2007 | Young et al. | |
| 2006/0239667 | A1 * | 10/2006 | Young et al. | 392/444 |
| 2007/0221663 | A1 * | 9/2007 | Brooks et al. | 219/544 |

* cited by examiner

*Primary Examiner* — Brian Jennison

(57) ABSTRACT

The present invention provides a heating device capable of dispensing heated personal care product while containers thereof are being heated. For example, there could be a base having multiple wells with a heating system associated with each well. There could be separate control of the heat in each well. The wells have an upper opening for permitting insertion of a container in them (in inverted fashion), and a side opening for permitting heated material in a container to be dispensed from the container while a portion of the container is being heated in the well. In another form, the invention provides a temperature sensor at the bottom of a heating well that projects into a heat conductive head of a container being warmed in the well. Methods for using such devices are also disclosed.

15 Claims, 4 Drawing Sheets

FIG. 1
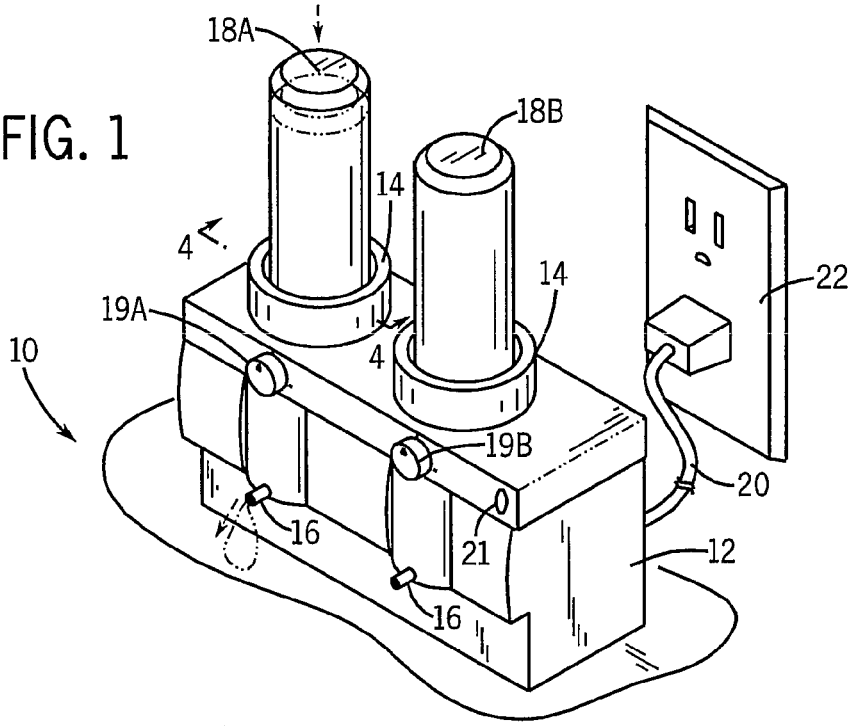
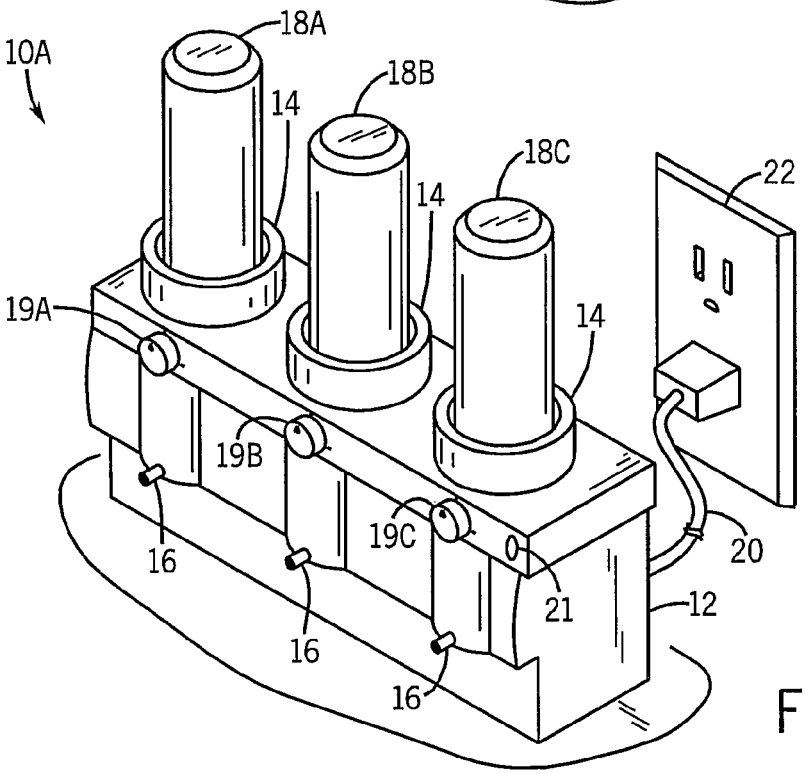
FIG. 2

DISPENSING DEVICE FOR HEATED FLOWABLE PRODUCT

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to dispensers used to warm the contents of one or more containers and then dispense the heated contents.

Products such as facial exfoliating scrubs, shaving creams, hand and body lotions, shower gels, and other flowable personal care compositions are commonly used. However, applying them when they are at room temperature is sometimes less preferred than applying them in heated form. For example, a heated shaving cream may more effectively protect against nicking and/or provide a smoother shave. Further, as room temperature liquids are well below normal body temperature, they may cause some discomfort when applied to the skin.

U.S. Pat. Nos. 3,843,022 and 6,454,127 describe devices for heating the contents of a bottle or can of a personal care product, and then dispensing those contents. However, these patents did not address how to simultaneously heat multiple cans or bottles.

In U.S. Pat. No. 6,444,956 multiple personal care bottles/tubes are shown as being heated simultaneously. However, this device requires a consumer to touch and remove a heated bottle or tube from the bay for use, and places certain limitations on how easily the product is dispensed.

U.S. Pat. No. 6,935,535 also discloses heating multiple containers simultaneously and dispensing material there from. However, the device shown is complex and expensive.

U.S. Pat. No. 7,158,717 discloses heating multiple containers simultaneously. However, it does not facilitate dispensing while the containers are in the heating device.

BRIEF SUMMARY OF THE INVENTION

In one aspect the invention provides a heating device. It has a base with at least a first well and a second well. There is a heating system associated with the wells and capable of heating a portion of a first container if the first container is positioned in the first well, and heating a portion of a second container if the second container is positioned in the second well.

Both the first and second wells have an upper opening for permitting insertion of a container therein, and both the first and second wells have an opening along their side for permitting heated material in a container to be dispensed from the container while a portion of the container is being heated in the well.

For example, in some embodiments, the heating system can be a single heater that heats both wells to the same temperature. Alternatively, the heating system may include a first heating element associated with the first well and a second separately controllable heating element associated with the second well. For example the heating elements could be resistance heating elements.

Where the first heating element can be separately controlled relative to the second heating element, this provides the option of having the two containers heated to different selected temperatures. Of course, the system could also select heating to the same temperature.

Varied forms of the openings through the side wall of the wells (e.g. the frontal side walls) are possible. For example, one could have slots extending down from the top opening for a majority of the vertical distance of the wells. Alternatively, one could have small through holes through a side wall of the wells, and those through holes could even link to forwardly projecting nozzles.

In still other embodiments there could be a temperature sensor associated with at least one (or alternatively both) well(s) capable of monitoring temperature of a container in a well when a container is in the well. This sensor could be linked to thermostatic control for controlling the temperature of the containers in the wells.

In most preferred embodiments there is at least a first container that is positionable in an inverted position in a well. Various embodiments have a head portion of the container heatable by a heating element associated with that well. The head portion could be formed of a heat conductive material, such as aluminum, preferably where the head has a serpentine pathway for the product created by baffling. In this embodiment the heat from a resistance heater or the like will be carried into the head, and the product will flow through a long enough path for that heat to transfer to the product at the head.

In various embodiments the container can matingly engage with a well, such as by having a portion of the container matingly engage with a temperature sensor positioned in a well. This temperature sensor extends up from a well into a portion of the container, and may be removed from the container by lifting the container from that well.

In another aspect the invention could provide a base having at least a first well, a second well, and a third well. A heating system is associated with all three wells and is capable of heating a portion of a first container if the first container is positioned in the first well, heating a portion of a second container if the second container is positioned in the second well, and heating a portion of a third container if the third container is positioned in the third well.

Each of the first, second and third wells have an upper opening for permitting insertion of a container therein, and each of the first, second and third wells have an opening along their side for permitting heated material in a container to be dispensed from the container while a portion of the container is being heated in the well, if the container is so positioned and is being heated. For example, in this embodiment there can be a temperature sensor associated with each well to sense temperature in the well such that each well can have its temperature controlled.

In yet another aspect the invention could provide a heating device with a base having a first well, and a first heating element associated with the first well capable of heating a portion of a first container if the first container is positioned in the first well. The first well has an upper opening for permitting insertion of a container in the well. That container is positionable in an inverted position in that well so that a head portion of the container is heatable by the heating element, that head portion being formed of a heat conductive material. In this embodiment at least a portion of the container can matingly engage with a temperature sensor positioned in that well so that the temperature sensor extends up from that well into a portion of the container, and may be removed from the container by lifting the container from that well.

In another aspect the invention provides a method for dispensing a heated skin care product. One obtains a heating device with a base having at least a first well and a second well, both the first and second well having an opening along their side. The device also has a heating system associated with the wells.

One then positions a first container in the first well in an inverted position, and a second container in the second well in an inverted position. Then, one dispenses a heated skin care product from at least one of the first and second containers through a side opening of one of the wells, preferably from both containers through their respective side openings.

Modifications can be made in implementing various embodiments. For example, in some embodiments the heating elements can be positive temperature coefficient heating elements in ring form that surround container conductive heads when the container(s) are inserted in the well(s).

It should be noted that the exact horizontal cross sectional shape of the containers and wells are not critical. For example, the containers and wells could all be generally circular in cross section, or they could all be generally oval, or they could have different cross sectional shapes relative to one another, as long as the containers can fit in the wells.

The nature of the flowable materials in the containers is also not critical. For example, one container could be an exfoliating scrub used prior to shaving, another could be a shaving cream that is used during shaving, and the third could be a skin lotion used after shaving. These could be flowable liquids or even flowable gels.

Various embodiments permit heated personal care products (most preferably skin care products such as facial scrubs, shaving cream, and skin lotion) to be easily dispensed while the containers holding them are still mounted in a heating device (without the need for removing the heated container for dispensing). This avoids having the product cool down before dispensing.

Further, in some embodiments where the bottle is inverted during dispensing the system can be designed to just heat that portion of the stored personal care product that is about to be dispensed. This saves energy and also helps reduce the possibility of degradation of the personal care product due to repeated heating and cooling before dispensing.

Some embodiments permit multiple containers to be heated simultaneously. This can result in either the personal care products being heated to the same temperature, or to different, carefully controlled, temperatures. In any event, the simultaneous heating helps avoid having the skin cool down before the next personal care product is applied.

Further, the present invention permits the use of containers which are relatively low in cost.

The foregoing and other advantages of the present invention will become apparent from the following description. It should be noted that not every claimed embodiment will necessarily have all of these advantages.

In the following description reference is made to the accompanying drawings which form a part thereof, and in which there is shown by way of non-limiting illustration preferred embodiments of the invention. The claims which follow thereafter should be looked to in order to judge the full scope of the invention.

BRIEF DESCRIPTION OF THE DRAWINGS

FIG. 1 is a right, front perspective view of a dual bay heater of the present invention;

FIG. 2 is a view similar to FIG. 1, but of a second embodiment with three bays;

DETAILED DESCRIPTION OF THE PREFERRED EMBODIMENTS

Figure 6:
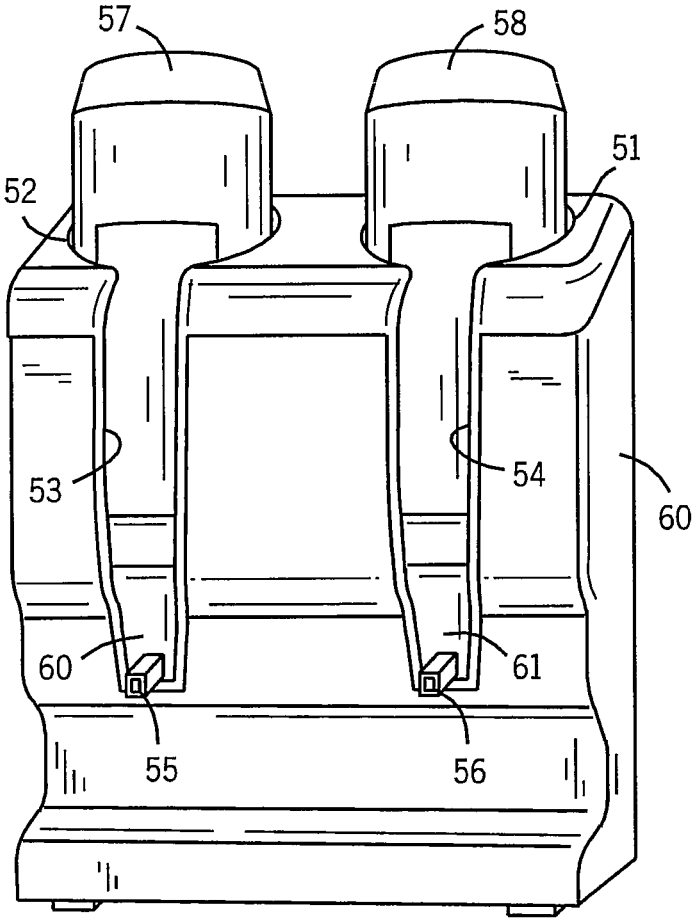
FIG. 6 is a frontal perspective view of a fourth embodiment.

Referring first to FIG. 1, the invention provides a dispensing device, generally 10, having a base 12 with at least two wells 14. The term "well" is being used broadly to include an upwardly open recess, even though the recess may have a very substantial opening along a wall (e.g. in the form of a slot such as shown in FIG. 6).

The FIG. 1 base 12 is shown as being powered by a power cord 20 for attaching to a conventional electrical outlet 22. Alternatively, it could be provided with a conventional battery, or a regenerative power source such as a solar cell. The base 12 also includes a conventional on/off power switch 21.

Both wells 14 are associated with a heating system that is capable of heating a portion of a container 18A and/or 18B. Both wells 14 also have an outlet opening. In the FIG. 1 embodiment this is in the form of a passage through the frontal side wall of the well linked to a projecting nozzle 16. This ultimately permits flow of heated material in a container 18 forward of the base. This dispensing can be achieved while the container 18 is still being heated in the well 14.

The dispensing device 10 could have its heating system designed, once turned on, to heat to a particular temperature limit and then hold at that temperature. Alternatively, and as shown in FIG. 1, there can be conventional heat control dials 19A and 19B to permit separate and more precise temperature control of the corresponding wells.

Hence, if the container 18A contains, for example, a heated facial scrub to exfoliate skin prior to shaving, and container 18B contains, for example, a heated shaving cream, one may want to heat the shaving cream more than the facial scrub. This FIG. 1 device permits that, as well as permits the shaving cream to be ready to be used immediately after the facial scrub is completed (before the skin cools down).

In FIG. 2 a second embodiment's dispensing device is referred to by numeral 10A. Similar parts carry the same number as in the FIG. 1 embodiment. However, as there is now a third container 18C, a third well 14, a third outlet 16, and a third heat control dial 19C. An exfoliating scrub could be included in container 18A, a shaving cream could be included in container 18B, and a skin lotion could be included in container 18C.

Figure 3:
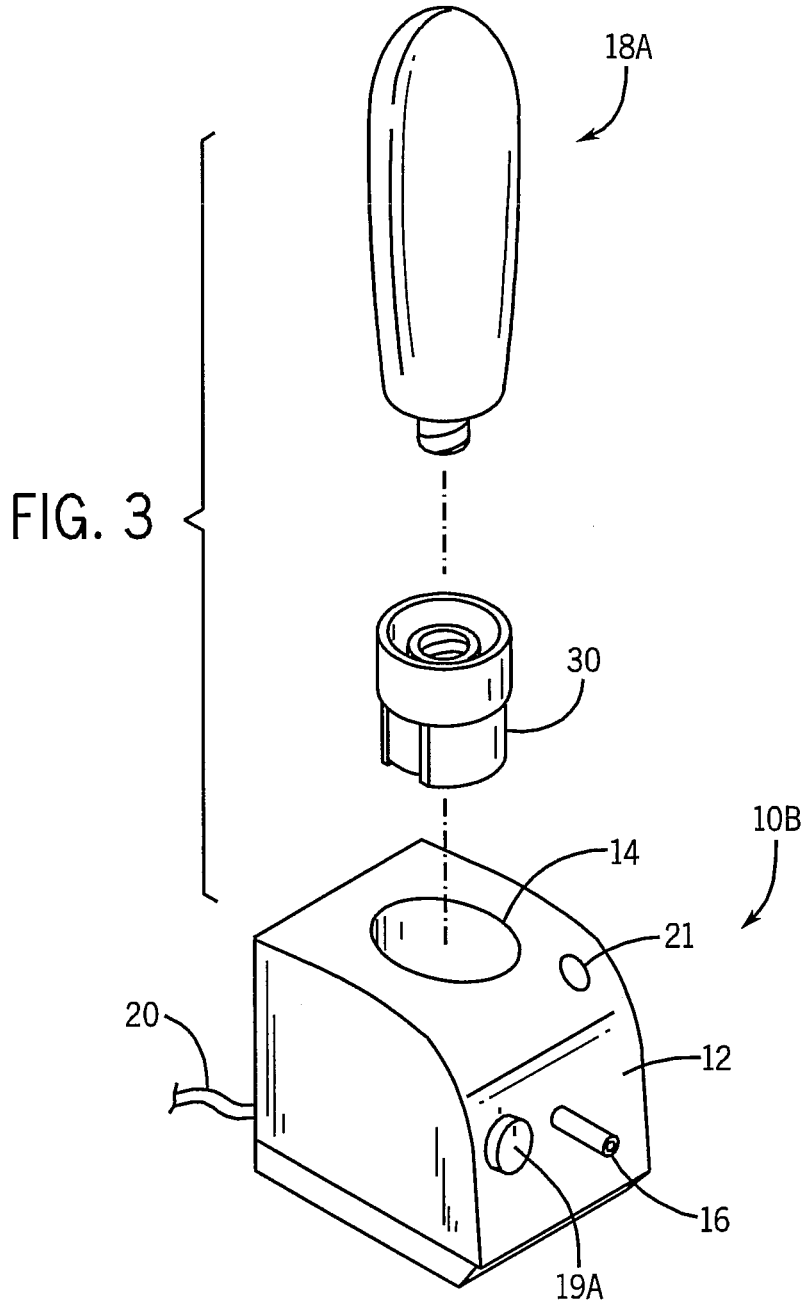
FIG. 3 is an exploded view of a third, single bay, embodiment, the parts thereof being shown partially exploded.

In FIG. 3 a third embodiment's dispensing device is now referred to by numeral 10B. Similar parts carry the same number as in the FIG. 1 embodiment. However, as there is now only one container 18A, there is now only one well 14, outlet 16, and heat control dial 19A. However, this embodiment is intended to use a sensor system like that in FIG. 4.

Figure 4:
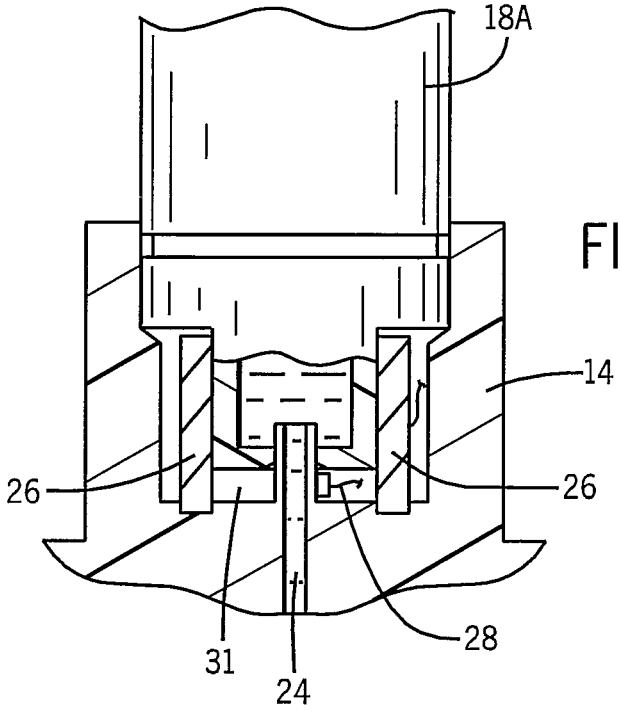
FIG. 4 is a cross-sectional view taken along line 4-4 of FIG. 1.
Figure 5:
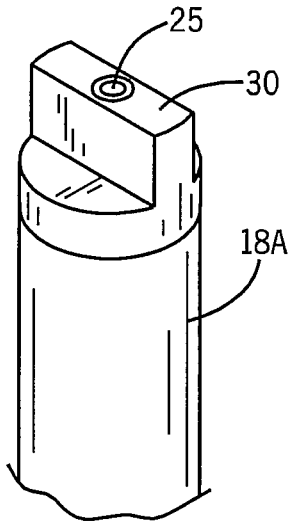
FIG. 5 is a bottom perspective view of the preferred liquid container shown in FIG. 4.

Regardless of the embodiment, and as seen in FIGS. 4-5, each well 14 may have associated with it a vertically extending sensor 24 linked to the composition being heated. A possible sensor for this purpose is a negative temperature coefficient (NTC), a thermocouple or alternative electronic temperature sensor.

The heating elements 26 may be positive temperature coefficient heating elements or alternative resistance type heating elements. The heating elements may be in the form of a surrounding ring or flat base surface that either directly contacts the head 30 for direct thermal conduction heating or does not contact the head 30 but heats via thermal convection.

The temperature sensor 24 associated with each well is in the form of a pin insertable in an outlet 25 of the container 18A. By projecting into the container it more accurately monitors temperature that the liquid or other flowable material that is about to be dispensed is facing. The temperature sensor 24 for each well 14 is linked to an electronically controlled thermostat 28, which via a controller will adjust the heating down or up to maintain a desired temperature.

As will be appreciated from FIG. 3, the container 18A is positionable in an inverted position in the well 14. In some embodiments the inverted container 18A has a head 30 that may be formed of a heat conductive material such as aluminum. This allows heat from the heater elements 26 to efficiently transfer to the head, and thus the liquid or other flowable material that is about to be dispensed. In an alternative embodiment, the head 30 may formed of a non heat conductive material and contain a heat conductive component such as a heat sink.

Regardless of the embodiment, these devices allow for efficient transfer of heat from the heating elements 26 to the liquid or other flowable material that is about to be dispensed. For example, a baffled/serpentine pathway through the head can be provided to improve the heat transfer, thereby avoiding the need to pre-heat the remainder of the container.

Alternatively, one could have more of the heater components associated with the head linked to the container with the base providing an electrical source therefore, or providing a means of inducing a current.

In other forms, the head 30 can have a configuration which, via a corresponding acceptor configuration in the well, can form a lock and key type interaction that inhibits use of heads and bottles not well suited for being heated.

In use one may squeeze the sides of the containers 18A-C, or alternatively otherwise causes a pumping pressure (e.g. axially pressing down on a pumpable structure). In the FIG. 5 embodiment this leads to liquid, gel or other flowable material being ejected down into a lower portion 31 of the well which has linked to it the side outlet 16. This ejects the heated lotion, cream or other material out the side outlet.

Note that if container 18A is disposed of when empty, the head 30 can be re-used with another refill container 18A. Alternatively, but not preferably, even the container 18A can be refilled and saved.

In FIG. 6 another embodiment is shown. Here the base 50 has two wells 51, 52. There are also frontal slots 53, 54 designed to accommodate outlets 55, 56 of containers. When the bottles 57, 58 are pressed down, this causes a pumping of the personal care product out the nozzles 55/56. The nozzles extend through the slots 53/54 so that the heated product can then be carried out of the wells, forwardly.

In this embodiment the lower portion of the wells may form part of a single resistance heater which heats both heads 60/61 simultaneously. That heat is conducted to the personal care product about to be dispensed. Alternatively, there may be separate heat elements and controls as before.

What has been described and depicted are merely the most preferred embodiments of the present invention. It should be appreciated that various changes can be made without departing from the spirit of the invention. For example, the containers can be cans instead of bottles, and can be rectangular or oval in cross section.

Thus, the claims should be looked to in order to judge the full scope of the invention.

INDUSTRIAL APPLICABILITY

The present invention provides heating devices for heating personal care compositions.

What is claimed is:

1. A heating device, comprising:

a base having at least a first well and a second well;

a heating system associated with the wells and configured for heating a portion of a first container if the first container is positioned in the first well and the heating system therefor is initiated, and configured for heating a portion of a second container if the second container is positioned in the second well and the heating system therefor is initiated;

both the first and second well having an upper opening for permitting insertion of a container therein, and both the first and second well having a frontal opening along their respective well side for permitting heated material in a container to be dispensed from the container through the respective well side while a portion of the container is being heated in the well, if the container is so positioned and is being heated;

wherein if a container is so positioned in a well there is a temperature sensor associated with that well that extends into that container in mating engagement where the temperature sensor is in contact with a flowable material in that container and is configured for monitoring temperature of the flowable material in that container in that well, wherein the temperature sensor is thereby mounted to project from a bottom portion of a well into a head portion of a container, wherein the temperature sensor can be inserted into that container in contact with the flowable material by placing that container in that well and removed from the container by lifting the container out from that well.

2. The heating device of claim 1, wherein the heating system comprises a first heating element associated with the first well and a second heating element associated with the second well.

3. The heating device of claim 2, wherein the first and second heating elements are resistance heating elements.

4. The heating device of claim 2, wherein the first and second heating elements are positive temperature coefficient heating elements.

5. The heating device of claim 2, where the first heating element can be separately controlled relative to the second heating element.

6. The heating device of claim 1, wherein both the first and second containers have a projection in the form of a side outlet, and said openings along the side of the wells extend downwardly from tops of said upper openings of the wells, in the form of frontal slots, in a manner in which the side outlets of the first and second containers can extend out of the slots when the container is placed in inverted fashion in the wells.

7. The heating device of claim 1, wherein said openings along the side of the wells are in the form of nozzles.

8. The heating device of claim 1, wherein the temperature sensor is linked to a thermostatic control for controlling the temperature of the container in a well.

9. The heating device of claim 1, further comprising at least a first container that is positionable in an inverted position in a well so that a head portion of the container is heatable by a heating element associated with that well.

10. The heating device of claim 9, wherein that head portion is formed of a heat conductive material.

11. The heating device of claim 10, wherein the heat conductive material is aluminum.

12. The heating device of claim 9, wherein at least a portion of the container can matingly engage with a well.

13. A heating device, comprising: a base having at least a first well, a second well, and a third well;

a heating system associated with the three wells and configured for heating a portion of a first container if the first container is positioned in the first well and the heating system therefor is initiated, configured for heating a portion of a second container if the second container is positioned in the second well and the heating system therefor is initiated, and configured for heating a portion of a third container if the third container is positioned in the third well and the heating system therefor is initiated;

each of the first, second and third wells having an upper opening for permitting insertion of a container therein, and each of the first, second and third wells having an opening along their side for permitting heated material in a container to be dispensed from the container while a portion of the container is being heated in the well, if the container is so positioned and is being heated;

wherein there is a temperature sensor mounted to project from a bottom portion of a well into a head portion of a container for monitoring temperature of flowable material in a container in that well when a container is in that well by extending into the container in mating engagement such that the temperature sensor is in contact with the flowable material, wherein the heating device is configured such that the temperature sensor will be inserted into that container in contact with the flowable material by placing that container in that well and removed from the container by lifting the container out from that well.

14. The heating device of claim 13, wherein the temperature sensor associated with each well to sense temperature in the well is such that each well can have its temperature controlled.

15. A heating device, comprising:

a base having a first well;

a first heating element associated with the first well configured for heating a portion of a first container if the first container is positioned in the first well and the heating system therefor is initiated;

the first well having an upper opening for permitting insertion of a container in the well; and a first container that is positionable in an inverted position in that well so that a head portion of the container is heatable by the heating element, that head portion being formed of a heat conductive material; and wherein at least a portion of the container can matingly engage with a temperature sensor mounted to project from a bottom portion of the well into a head portion of the container so that the temperature sensor extends up from that well into a portion of the container in contact with flowable material in the container, and may be inserted into the container by placing the container in that well, and may be removed from that container by lifting that container out from that well.

* * * * *